US011180228B1

(12) United States Patent
Scheffer et al.

(10) Patent No.: US 11,180,228 B1
(45) Date of Patent: Nov. 23, 2021

(54) METHOD AND APPARATUS FOR SECURING STOWABLES

(71) Applicants: Paulette Scheffer, Kula, HI (US); Tamara Evans, Kihei, HI (US)

(72) Inventors: Paulette Scheffer, Kula, HI (US); Tamara Evans, Kihei, HI (US)

( * ) Notice: Subject to any disclaimer, the term of this patent is extended or adjusted under 35 U.S.C. 154(b) by 0 days.

(21) Appl. No.: 17/314,134

(22) Filed: May 7, 2021

(51) Int. Cl.
*B63B 34/26* (2020.01)
*B63B 25/00* (2006.01)

(52) U.S. Cl.
CPC ..... *B63B 34/26* (2020.02); *B63B 25/002* (2013.01)

(58) Field of Classification Search
CPC ..... B63B 34/26; B63B 25/002
See application file for complete search history.

(56) References Cited

U.S. PATENT DOCUMENTS

| | | | | |
|---|---|---|---|---|
| 3,863,588 | A * | 2/1975 | Gillespie | B63B 21/04 114/218 |
| 6,257,614 | B1 * | 7/2001 | Duggan | A63C 10/14 280/14.24 |
| 6,470,533 | B1 * | 10/2002 | Comstock | A45F 5/102 16/406 |
| 7,371,141 | B1 * | 5/2008 | Lin | B63B 32/73 441/75 |
| 8,875,965 | B2 * | 11/2014 | Corets | B60R 7/043 224/666 |
| 9,392,863 | B2 * | 7/2016 | Hamilton | A45F 5/021 |
| 9,931,530 | B2 * | 4/2018 | Bonner | B63B 32/73 |
| 10,039,368 | B2 * | 8/2018 | Christman | A45F 3/14 |
| 2014/0315455 | A1 * | 10/2014 | Hanska | B63B 32/70 441/75 |
| 2021/0155324 | A1 * | 5/2021 | Cordery | B63B 34/21 |

* cited by examiner

*Primary Examiner* — S. Joseph Morano
*Assistant Examiner* — Jovon E Hayes

(57) ABSTRACT

An apparatus for securely attaching various stowable items on watercraft is provided. The apparatus allows for non-destructively attaching a mount or base to one or both sides of the craft. A number of securing strap configurations can be added to the base, the straps secured to the base so as to limit movement of the strap.

8 Claims, 8 Drawing Sheets

METHOD AND APPARATUS FOR SECURING STOWABLES

1. FIELD OF THE INVENTION

The present invention generally relates to accessories for watercraft and recreational vehicles. More specifically, the present invention relates to an apparatus for attaching stowables to a watercraft.

BACKGROUND OF THE INVENTION

Watercraft and recreational vehicles (RVs) have become popular in recent years. These watercraft and vehicles, such as kayaks, canoes, jet skis, 3 wheelers, etc., are often purpose built and streamlined such that stowage compartments and the like are not built in. Even when stowage compartments are available they may be inadequate for lack of capacity or other reasons. Users of watercraft and RVs however, often have various items they may wish to securely stow. These items vary depending upon the watercraft or vehicle but may include oars, camping equipment, food and water, first aid and safety equipment, personal items, and the like. Stowing these items on the vehicle can be unsafe as well as often resulting in the loss of the item.

Many watercraft are made from fiberglass or other synthetic material which makes drilling holes for attachments undesirable. Also, drilling holes can affect both the seaworthiness and value of the craft. Accordingly, it is desirable to provide a method of securely stowing items on a vehicle, especially small watercraft, which is easy to install and effective.

An apparatus for securely attaching various stowable items on watercraft is provided. The apparatus allows for non-destructively attaching one or more mounts or bases to interior or exterior surfaces of the watercraft. A securing strap can be configured to attach to and secure a wide variety of items, the straps secured to the base by an attaching member, the attaching member locked so as to prevent or limit movement relative to the base. A modified version of the securing strap may be used to secure items without a mount.

SUMMARY OF THE INVENTION

It is a major object of the invention to provide an improved apparatus for attaching stowables to a watercraft or vehicle.

It is another object of the invention to provide an improved apparatus for attaching stowables to a watercraft.

It is another object of the invention to provide an improved apparatus for attaching stowables to a watercraft that can be non-destructively attached.

It is another object of the invention to provide an improved apparatus for attaching stowables to a watercraft that uses one or more mounts.

It is another object of the invention to provide an improved apparatus for attaching stowables to a watercraft that can be mounted both interiorly and exteriorly of the watercraft.

DETAILED DESCRIPTION

Figure 1:
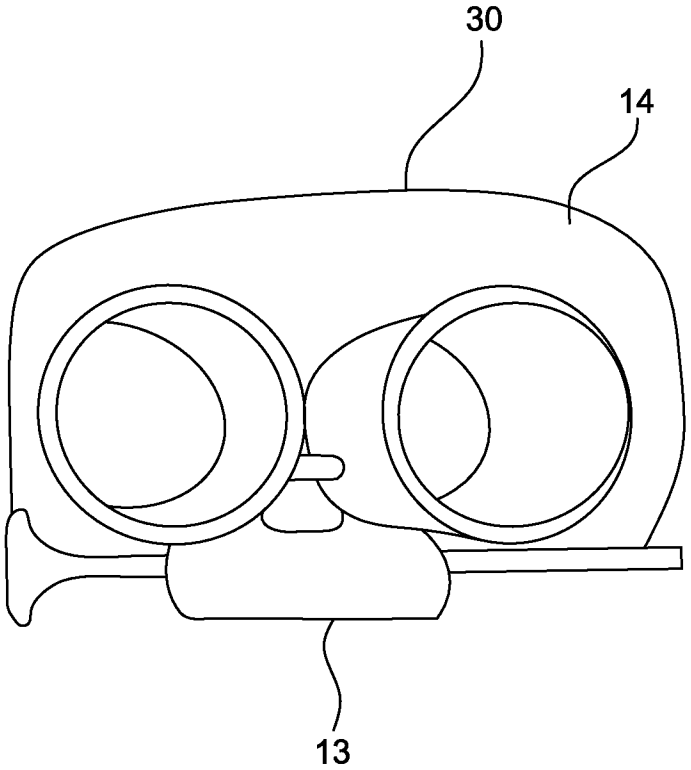
FIG. 1 is a perspective view of a component of the apparatus of the invention.
Figure 2:
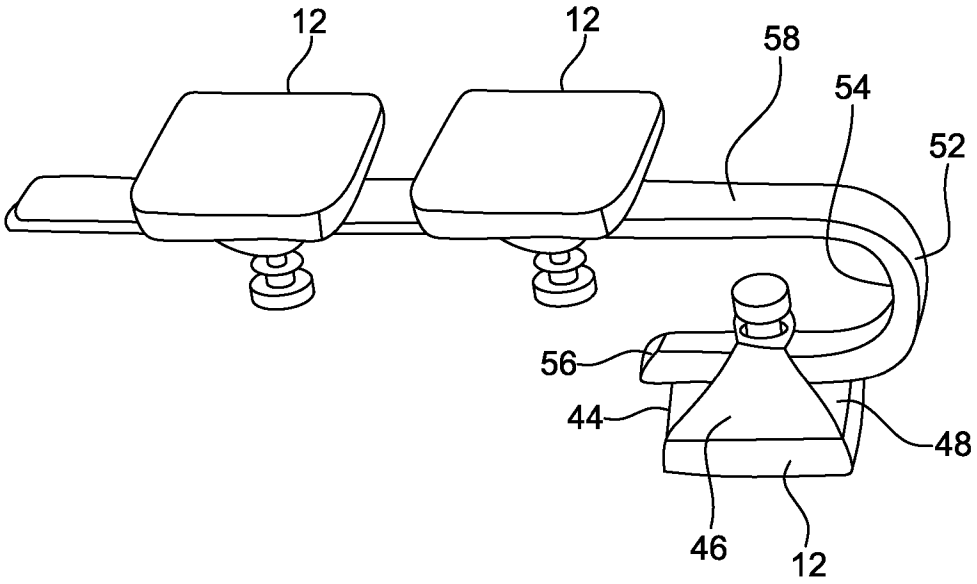
FIG. 2 is a perspective view of a component of the apparatus of the invention in a first configuration.
Figure 3:
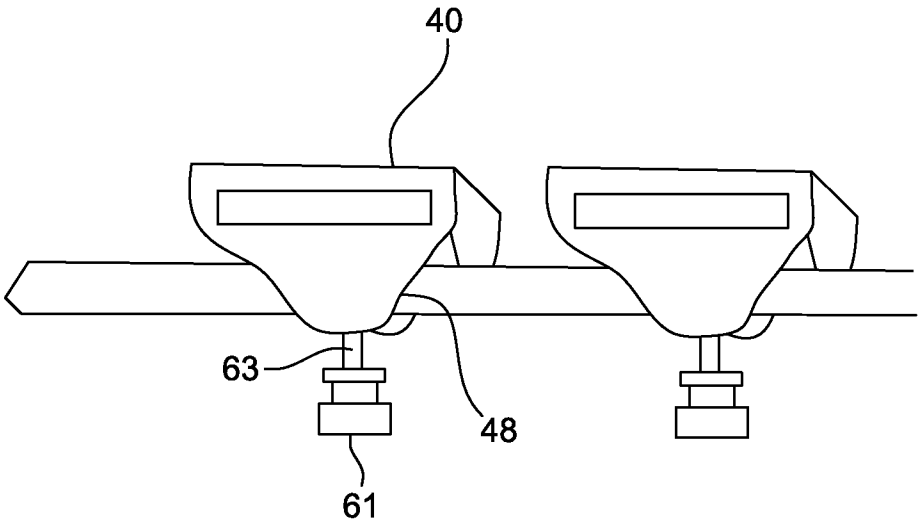
FIG. 3 is a detail of FIG. 2.
Figure 4:
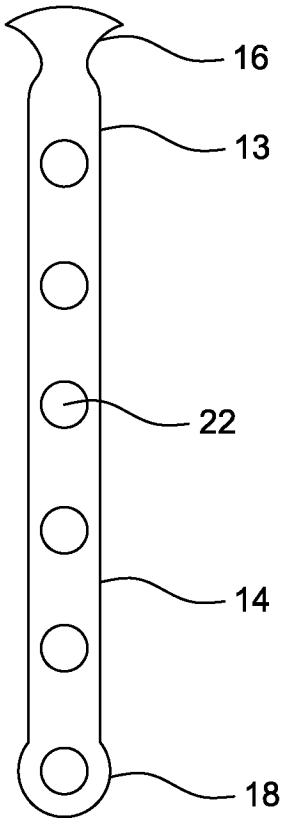
FIG. 4 is a plan view of a strap used with the apparatus.

Referring now to FIGS. 1-6, the inventive apparatus, generally indicated by the numeral 10, is shown. The apparatus 10 has two main components, the rigid mount or base 12 and the attachment means. A key aspect of the invention is that the base 12 can be mounted to a watercraft 11 or RV in a non-destructive manner. Also, the attachment means, which takes several forms, may be configured for use without a rigid mount and is both size and shape adaptable. The apparatus 10 is designed to stow items on or within the watercraft 11. The items may range from essential gear such as paddles, to various personal items. Thus, a highly adaptable attachment apparatus 10 is provided.

The base 12 is made of a durable high strength material such as metal or high strength plastic. Preferably, the base 12 is made of aluminum or other rust resistant metal. Regardless of the material used, the ability to conform to a curved surface while still maintaining structural integrity is preferable. A high strength plastic may be used, provided it can withstand the loading which can be placed on the base 12, the choice of materials based on anticipated loading would be apparent to one of skill in the art. An adhesive such as a waterproof tape 13 or other strong adhesive is used to secure the base 12 to the side of the watercraft 11. In one deployment scenario, one base 12 is secured to each side of the watercraft 11. In another example, two bases 12 may be secured on one side of the watercraft 11 to support elongated items like oars. It should be noted that the number and position of the bases 12 can be determined by the user, the positions as shown are merely exemplary.

The base 12 is configured to secure a flexible attachment member or means such as a strap 14. The strap 14 is flat and elongated and has male 16 and female 18 coupling members disposed at respective ends of the strap 14. A plurality of apertures 22 disposed along the length of the strap 14 are sized for snap fit coupling with the male end 13 of the strap 14 to allow for adjusting the size of the loop 30 formed when the strap 14 is coupled. As the strap 14 is made from a flexible, preferably elasticized material such as natural rubber, a discrete number of apertures 22 is sufficient to ensure that the straps 14 can be tightly positioned around virtually any object.

The base 12 includes an opening 40 which is sized to slidably receive a strap 14 in non-twisting relation, that is, the opening 40 is close enough to the cross sectional dimensions of the strap 14 to prevent twisting thereof, this arrangement causes the strap to be oriented substantially vertically or horizontally depending upon the orientation of the base 12. Opposing sloped arcuate sidewalls 44 are adapted to provide an abutment surface to abut elongated cylindrical items such as an oar 29 (when positioned as shown in FIG. 1) with minimal spacing or gap between the oar 29 and the sidewalls, this configuration minimizing relative movement of the oar when attached to the base 12. The sidewalls 44 are formed in the upper portion 46 of the base, which upper portion 46 includes an opening 48 sized to slidably receive an orientation bar 50, the bar essentially forming part of a more elaborate attachment means as described below.

The bar 50 is elongated with a trapezoidal cross section corresponding to opening 48 so as to avoid twisting of the bar 50 within inserted into opening 48. One end 52 of the bar 50 has a curved, U-shaped end portion 54 which terminates in a relatively short segment or attachment portion 56 which lies in spaced parallel relation to the main body 58 of the bar 50. The attachment portion 56 can be attached to the watercraft 11 using a single base 12, the base 12 attached as described above. One or more bases 12 can be attached to the main body 58, with the orientation thereof being determined by the orientation of segment 56 which is affixed to the watercraft 11. Straps 14 may be looped through opening 40 to secure items in either a horizontal or vertical plane depending upon orientation of the base 12 connected to segment 56, this base being attached in accordance with a desired orientation of the bases 12 attached to the main body 58. One or more bases 12 may be held in position along the bar 50, each base having a set screw 61 which is inserted into and through aperture 63, the end of the screw 61 impinging upon the bar with sufficient force after tightening to secure the base 12 in position on the bar 50.

Figure 6:
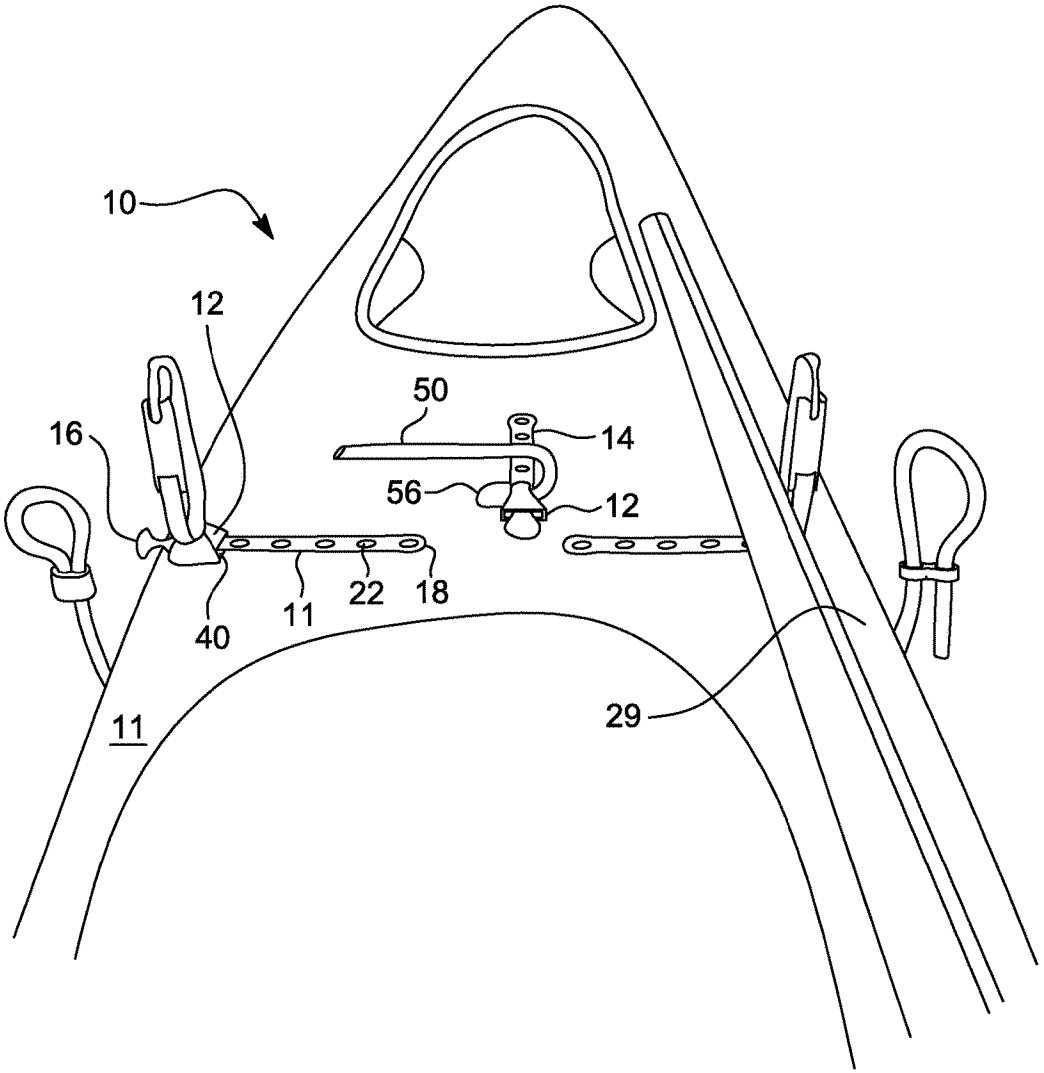
FIG. 6 is a perspective view of a watercraft utilizing the invention.

Thus, the orientation bar 50 allows for positioning a number of bases 12 in spaced relation, and with a desired orientation, to the hull of the watercraft 11, the bar 50 and bases 12 essentially forming an attachment member extending from the single base 12 attached to the watercraft 11 via segment 56. In addition to preventing damage to stowables from coming into contact with the hull (or damage to the hull from stowables), the bar 50 allows for positioning and orienting stowables in spaced relation anywhere on the watercraft 11 for easy access as can be seen in FIG. 6, with position and orientation being sometimes varied depending upon the shape and size of the item being secured.

With the strap 14 positioned as shown in FIG. 1, the strap 14 is loosely looped to capture an item such as an oar 29 (shown in cross section). In use, the loop 30 is then sized to firmly attach about the oar 29, that is, the loop 30 is adjusted for diameter by selecting one of the apertures 22 for coupling with male coupling member 16. It can be appreciated that two or more bases 12 may be used to secure elongated items such as oars 29, which can be optionally secured at both ends for safety.

Figure 5A:
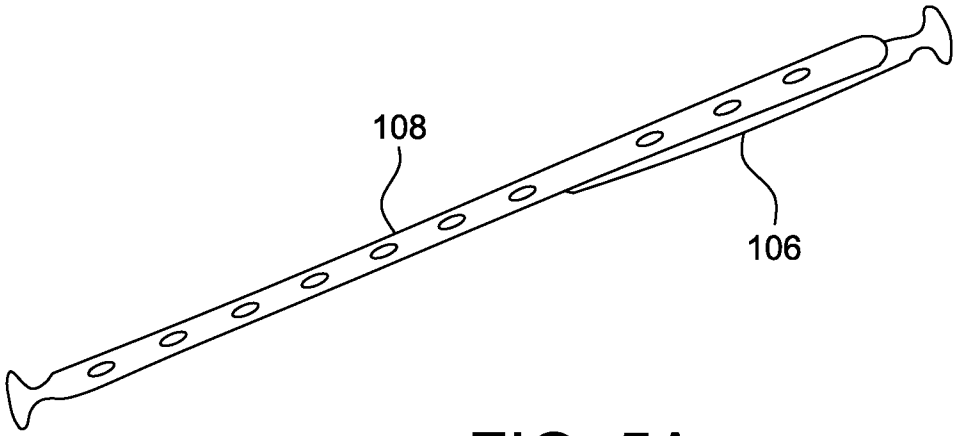
FIG. 5A is a perspective view of an alternative embodiment of a strap used with the apparatus.
Figure 5B:
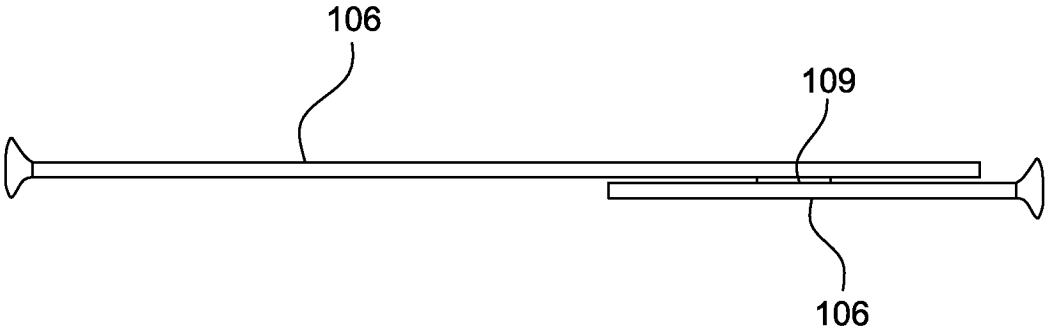
FIG. 5B is a side view of FIG. 5A.
Figure 5C:
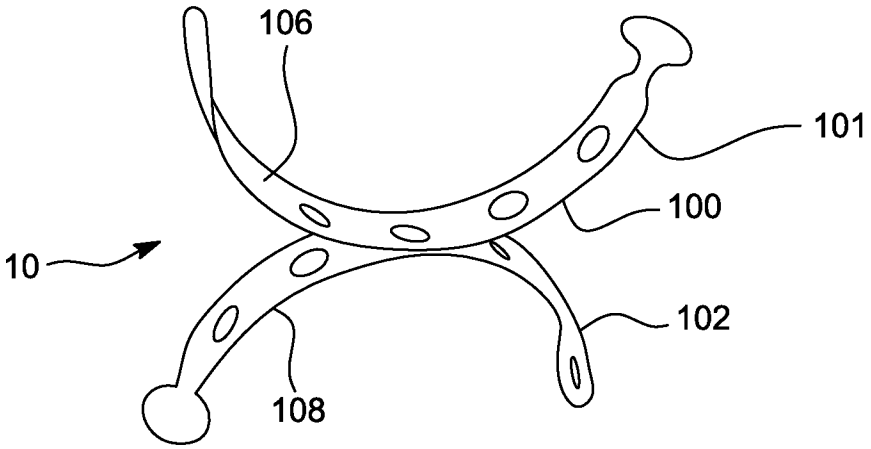
FIG. 5C shows the straps of FIG. 5A forming opposing loops.

The apparatus 10 may be used without a mount or base 12 by forming a two loop strap assembly 100. This configuration, as shown in FIGS. 5A and 5B, allows for a first 101 and second loop 102. The first, relatively small, loop 101 is attached to (looped around) a sturdy, fixed attachment point 104 on or within the watercraft 11 such as a handle. The second, relatively larger, loop 102 is attached to the item to be secured. The assembly 100 is formed by fusing two different length straps 106, 108 configured as described above, with strap 106, the smaller strap, used to attach to the watercraft 11. Strap 108 is fused to strap 106 at an approximate midpoint 109 of strap 106 using any appropriate means to ensure strength of the connection, the straps 106, 108 positioned in back to back relation. The position of strap 106 on strap 108 is toward one end of the strap 108 as shown.

Figure 7:
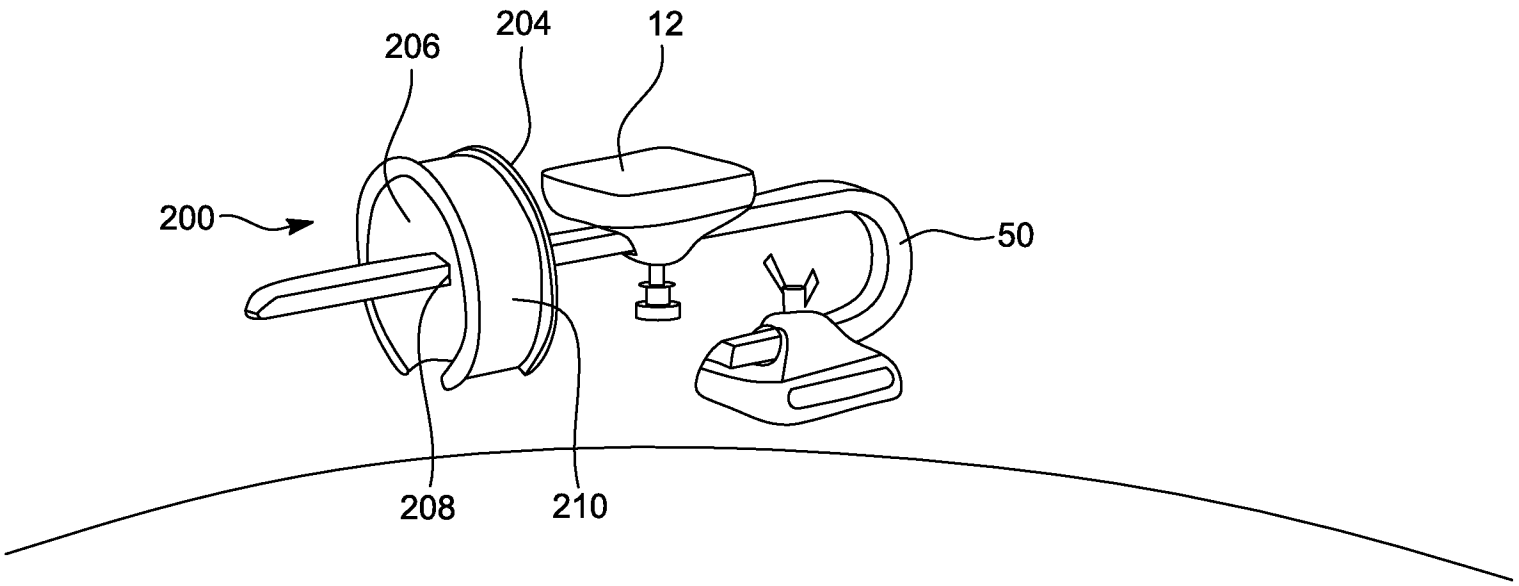
FIG. 7 is a perspective view of an alternative attachment means.

An alternative attachment arrangement is shown in FIG. 7. This attachment arrangement utilizes a specialized attachment device, generally indicated by the numeral 200, which is rigid and is used as a mount for devices such as watches. The component 200 includes a generally tubular main body 204 having an interior portion 206 of reduced diameter, the portion 206 having an internal bore 208 with a trapezoidal cross section corresponding to the cross section of the orientation bar 50. Thus, the component 200 can be attached to an orientation bar 50 by sliding the component 200 onto the bar 50. The component 200 cannot rotate because of the interaction between bar 50 and the internal bore 208. Inadvertent sliding is limited due to friction between the bore 208 and bar 50, although the friction between bar 50 and component 200 is not so great as to render removal of the component 200 by a user of average strength. The component 200 may be made from a rubberized, metal, or hardened plastic material, with a rubber material providing sufficient friction to prevent unintended displacement or sliding. Items can be attached to component 200 by way of a clamp, or a female attachment means sized for frictional engagement with outer surface 210 of the component. Regardless of the material used, outer surface 210 is knurled or textured to enhance friction to better retain items attached thereto. A watch, bracelet, or other item having a circumference close to the circumference of component 200 may be attached around the component.

Figure 8:
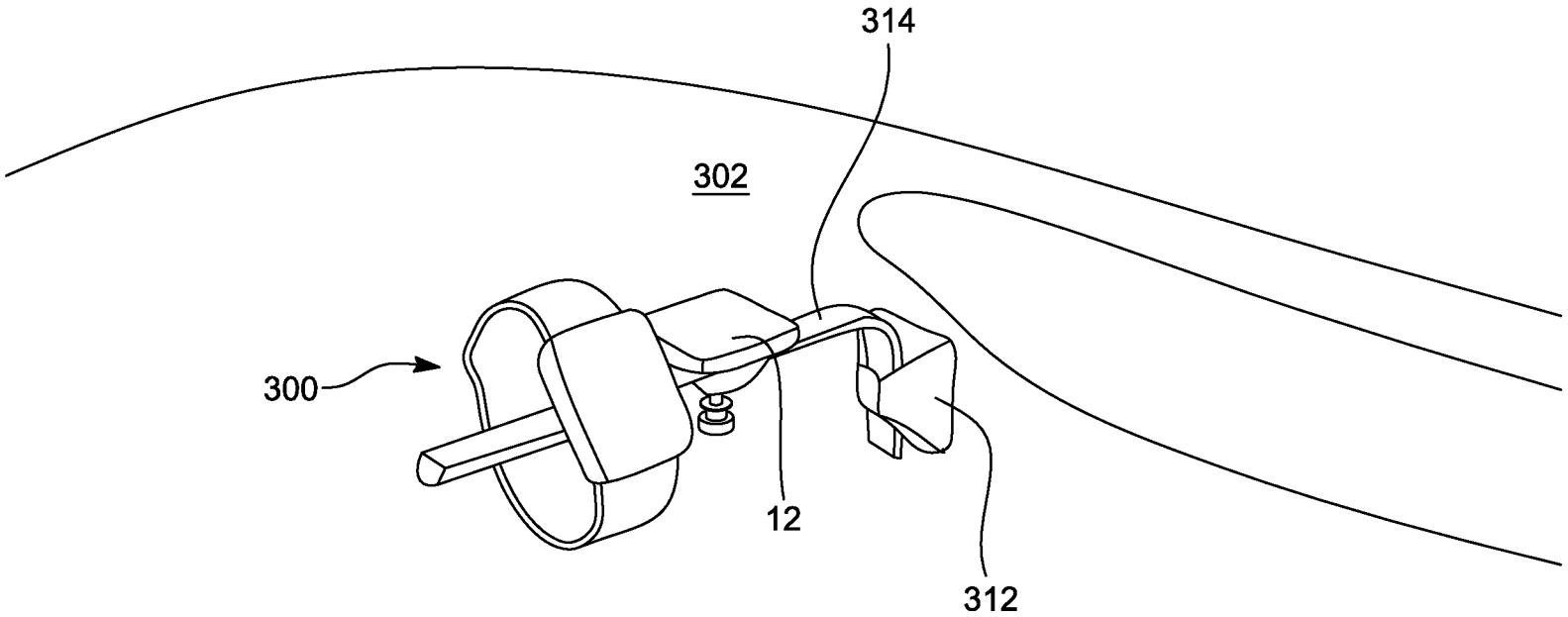
FIG. 8 is a perspective view of an alternative attachment means.

Referring now to FIG. 8, an alternative attachment bar, generally indicated by the numeral 300 is shown. The bar 300 has an L-shape and has a particular advantage for connecting to an interior sidewall 302 of the watercraft 11. When so connected, the base 12 is positioned away from the sidewall 302. This bar 300 has particular utility because the sidewall 302 comprises most of the useful interior surface area (for attachment purposes) of a small watercraft 11. As with attachment bar 50, a base or mount 312 may be used to attach bar 300 to the watercraft 11. One or more bases 12 may be positioned along the main body 314.

We claim:

1. An apparatus for attaching items to a watercraft comprising:

a base for attachment to said watercraft, said base having an upper portion and a lower portion;

an opening formed in said upper portion;

an attachment member releasably positioned within said opening, said attachment member forming a size adjustable loop; and an orientation bar, said orientation bar having an elongated main body and a curved end portion terminating in an attachment portion, said main body and said attachment portion in parallel spaced relation.

2. The apparatus of claim 1 wherein said lower portion has a surface on which an adhesive is placed to secure said base on said watercraft.

3. The apparatus of claim 2 wherein said adhesive is waterproof double sided tape.

4. The apparatus of claim 3 wherein said attachment means is a strap with a flat cross section, and one end of said strap has a male connecting member for attachment within one of a plurality of spaced apertures formed in said strap to form said loop for attachment to said items.

5. The apparatus of claim 4 wherein said opening in said upper portion has a cross sectional shape corresponding to the flat cross section of said strap.

6. The apparatus of claim 1 wherein one or more bases may be attached to said elongated main body.

7. The apparatus of claim 1 wherein a generally cylindrical attachment component is slidably attached to said main body.

8. An apparatus for attaching items to a watercraft comprising:

a base for attachment to said watercraft, said base forming a first size adjustable loop;

an attachment member forming a second size adjustable loop;

said base and said attachment member attached at an approximate midpoint to form back to back size adjustable loops; and an orientation bar, said orientation bar having an elongated main body and a curved end portion terminating in an attachment portion, said main body and said attachment portion in parallel spaced relation.

* * * * *